United States Patent [19]

Brown

[11] 3,970,527

[45] July 20, 1976

[54] ELECTROFORMATION OF THE RUNNING TRACK OF A ROTARY INTERNAL COMBUSTION ENGINE

[75] Inventor: Henry Brown, Sarasota, Fla.

[73] Assignee: Oxy Metal Industries Corporation, Warren, Mich.

[22] Filed: Mar. 27, 1975

[21] Appl. No.: 562,609

Related U.S. Application Data

[63] Continuation-in-part of Ser. No. 316,207, Dec. 18, 1972, Pat. No. 3,856,635, which is a continuation of Ser. No. 421,302, Dec. 3, 1973.

[52] U.S. Cl. ..... 204/9; 29/527.3; 204/4; 418/178

[51] Int. Cl.[2] ..... C25D 1/02; C25D 1/20

[58] Field of Search ..... 204/3, 4, 9; 29/527.3; 164/131; 418/178

[56] References Cited

UNITED STATES PATENTS

| | | | |
|---|---|---|---|
| 2,592,614 | 4/1952 | Stoddard, Jr. | 204/9 |
| 2,682,500 | 6/1954 | Tanner | 204/6 |
| 3,132,927 | 5/1964 | Borner | 204/9 |
| 3,155,313 | 11/1964 | Bentele | 418/178 |

OTHER PUBLICATIONS

Product Engineering, June 5, 1961, pp. 609–614.

*Primary Examiner*—T. M. Tufariello
*Attorney, Agent, or Firm*—B. F. Claeboe

[57] ABSTRACT

This invention relates to a method of electroforming the epitrochoidal running track for the rotor of a rotary internal combustion engine. The method involves the electrodeposition of a sequence of plates on a mandrel of epitrochoidal shape and having a chromium surface, and casting an aluminum alloy housing onto the final plate. The sequence of plates applied to the mandrel with the chromium surface involving (1) a first plate of poor adherence selected from the group consisting essentially of nickel, cobalt, iron or their alloys, (2) a wear-resistant plate and (3) a final plate to aid in securing good adhesion of the aluminum housing cast thereon. These are the main steps. Intermediate steps may also be involved such as using two or more wear-resistant plates in step (2). Also step (1) with step (2) can be combined in one plating step.

15 Claims, No Drawings

ELECTROFORMATION OF THE RUNNING TRACK OF A ROTARY INTERNAL COMBUSTION ENGINE

CROSS REFERENCE TO RELATED CASES

This case is a continuation-in-part of Application Ser. No. 316,207 filed Dec. 18, 1972, now U.S. Pat. No. 3,856,635 which in turn is a streamline continuation of Application Ser. No. 421,302, filed Dec. 3, 1973.

This invention relates to both a method and certain sequences of electroplating steps for electroforming a wear-resistant track in the aluminum housing of rotary combustion engines, especially the electroforming of the epitrochoidal track of the aluminum housing of the Wankel rotary gasoline engine. In particular, the method relates to electroforming the track by electrolating a series of plates on a mandrel that has for the Wankel rotary engine, the epitrochoidal shape and size of the track, and then casting the aluminum housing on to the last electroplate and removing the housing with the attached electroplates containing the wear plate or plates.

The present method used for obtaining a wear-resistant surface for the epitrochoidal track in the aluminum housing of the Wankel rotary engine is to die-cast the aluminum housing directly on to the mandrel or on to a porous sprayed iron transplant applied to the mandrel, and then electroplating a thick nickel plate containing codeposited fine silicon carbide particles on to the epitrochoidal track on the inside of the aluminum housing or a thick chromium plate on top of the iron transplant. Then the thick plate is machined to exact size. These methods require internal anodes to plate the track, and much metal must be wasted because an extra thick plate must be electrodeposited, usually twice the final thickness to be left after machining and honing to the final size for the bore. Also the time needed to plate the thick plate adds greatly to the expense.

In the method of this invention it is the mandrel that is plated instead of the internal track of the aluminum housing, and using a mandrel with a high finish and exact size, very little if any machining is needed for the epitrochoidal surface. Thus thinner hard plate can be used and little if any plated metal need be lost by machining.

To make possible successful commercial use of the system wherein the outside of the mandrel is electroplated instead of the inside of the aluminum alloy housing, it is necessary (1) that the plate can be readily detached from the mandrel and (2) that the aluminum die cast housing adheres with good bond to the final plates.

Using a highly finished accurate mandrel, much less machining or grinding if any would be needed for a final accurate surface with this method than for the present method of plating the inside of the aluminum alloy housing. The present method requires the electrodeposition of very thick plate, around 15 to 20 mils, to be sure to have sufficient plate left (4 to 6 mils) after grinding or machining, and this is a great economic loss. This expensive procedure which is used to plate the inside of the aluminum housing results from the fact that the plate becomes less smooth as the thickness is increased and also because the plate distribution is relatively poor from acidic baths (nickel and chromium) which results in a non-uniform thickness of plate on the epitrochoidal surface. In the method of plating the outside of the mandrel, it is the first part of the plate which is used and it is as smooth as the mandrel and as accurate in dimensions as the mandrel. Thus, even if the mandrel is not absolutely accurate in dimensions, the amount of maching or grinding needed is far less than the present method of plating the inside of the housing. Furthermore, the first plate or plates deposited on the mandrel may be relatively thin plates of less hard material than the wear-resistant plates, and these plates can be readily machined or honed, and even could be used as wear-in plate before the wear-resistant plate is reached. This type of plate will be illustrated in some of the examples given below.

The method of electroplating the outside of the mandrel instead of the inside of the aluminum alloy housing, also makes possible the use of new wear-resistant plate that is much less expensive than the presently used wear-resistant plates of thick nickel containing about 2.5 wt. % of codeposited fine silicon carbide particles, or of thick chromium plate ("hard chrome"). The new wear-resistant plate for the Wankel rotary engine is described in Example 1 and consists of electroplated iron containing 2.5 wt. % and over a codeposited fine silicon carbide particles. In the low pH (around pH of 1), very warm (around 160°–190°F) iron plating baths, it is possible to codeposit on vertical surfaces, twice as much fine silicon carbide particles than with nickel baths. Since less or even no machining or grinding of the hard wear-resistant surface need be done, the hardest possible wear-resistant plate can be used, that is, iron or nickel plate or their combination, with higher percent (up to 8 wt. % in the iron plate) of codeposited silicon carbide particles. With the plating of the epitrochoidal track on the inside of the aluminum alloy housing, it is too difficult to use a low pH hot iron plating bath because of the attack on the aluminum housing in the areas not receiving plate.

Actually more than one wear-resistant plate can be much more readily used when the mandrel is plated instead of the inside of the aluminum alloy housing as is illustrated in Examples 2 and 3.

EXAMPLE 1

A steel mandrel with good surface finish and close or equal to the desired dimensions of the epitrochoidal track (approximately 9.5 in. for the longest diameter of the epitrochoidal track, about 7 in. for the pinched-in diameter, and about 2.4 in. for the width is electroplated with the following sequence of plates.

1. A thin lead plate of about 0.1 mil or even less is first plated on the steel mandrel, for example, by using an acid lead fluoborate bath preferably containing one or more addition agents selected from the group consisting of gelatin, naphthol, a nonionic wetting agent, and lignin sulfate. This can be a 1 or 2 min. plate.

2. This is followed by a copper plate, preferably from a bright acid copper sulfate plating bath such as the cross described in U.S. Pat. Nos. 2,707,166, 2,738,318, 3,288,690 and 3,328,273. The copper plate can be about 0.1 to about 0.2 mil thickness.

3. This is followed by an iron plate containing codeposited fine silicon carbide particles in about 2.5 wt. % to about 8 wt. %. The iron bath can be made up of principally ferrous chloride, about 300 g/l, with or without about 150 g/l of calcium chloride and operated at pH of about 1, and bath temperature of about 160°–190°F. The silicon carbide powder concentration can be from about 25 to 150 grams per liter dispersed in the bath by mechanical agitation. Instead of ferrous chloride, the bath can be made up of principally ferrous sulfate, operated as described above for the ferrous chloride bath. Lower current densities usually are used for the ferrous sulfate bath, compared to the chloride bath. However, the low pH warm sulfate bath has the advantage that no corrosive hydrochloric acid fumes arise from the bath as is the case with the chloride bath.

The iron plate with the codeposited silicon carbide particles is deposited in a thickness of about 2 mils to even 10 mils or more if desired. The last 1 mil or 2 mils of the thicker plate can use coarser silicon carbide particles in a separate bath to yield a rough plate of firmly imbedded silicon carbide particles in the iron plate. This rough plate will help the bond to the subsequent aluminum alloy housing that is cast onto this plate. Preferably, instead of casting the aluminum alloy directly onto this iron surface, a thin zinc plate of about 0.1 mil to about 2 mils is plated onto the iron surface and then the aluminum alloy casting step follows. The zinc plate can be deposited on a smooth iron plate as well as a rough one, and will greatly aid in the bonding of the aluminum to the iron plate. The zinc will melt as the hot aluminum alloy metal hits the zinc and most of the zinc will go into the aluminum alloy and some into the iron plate. This method allows the aluminum alloy to contact iron plate that has no oxide coating on it, the iron surface having been protected by the zinc plate.

The heat from the molten aluminum alloy will cause the melting of the thin lead deposit against the steel mandrel, and this makes possible the removal from the mandrel of the plate with the aluminum housing attached. The mandrel may be hollow, that is in the form of an epitrochoidal ring, or have holes in it for cooling purposes. The cooling of the interior of the mandrel (with cold water) will cause contraction and can aid in the removal of the plate with its attached housing.

The final zinc plate is preferably of high purity to help attain the best bonding of the aluminum to the fianl plate or plates. On the other hand, for the first plate or plates against the mandrel, it is best to use baths with inclusions, as from addition agents to aid in obtaining the poor adhesion necessary for separation from the mandrel. Lead, ith its low melting point (327°C), loses its adhesion to steel and also the molten lead at these temperatures is practically insoluble in the copper that was plated on top of it. With the cooling of the mandrel, as with the circulation of water through a cylindrical hollow or an epitrochoidal hollow or through holes in the interior of the mandrel, the contraction that results also aids in the separation from the mandrel at the lead interface.

EXAMPLE 2

The same procedure as in Example 1, except that nickel plate with codeposited fine silicon carbide particles to the extent of about 2.5 wt. % and higher is used instead of all of the iron plate with codeposited silcon carbide particles or instead of a portion of the iron plate.

The nickel plate with the codeposited silicon carbide particles can be deposited from the acidic baths of the Watts type, high chloride or high bromide types, or sulfamate or fluoborate. Since the acidic fluoborate type will attack titanium anode baskets, the fluoborate type is not preferred over the other types. The nickel baths may contain Class I addition agents such as benzene or toluene sulfonamide, di-benzene or di-toluene sulfonimides, o-benzoyl sulfonimide (saccharin), benzene mono- or di-sulfonic acids, benzene and toluene sulfinic acids, napthalene sulfonic acids, allyl sulfonic acid, o-sulfobenzaldehyde (or the sodium or potassium and similar salts of these various sulfonic acids), sulfonimides, and sulfinic acids or other similar Class I compounds. These Class I compounds cause the incorporation of about 0.01 to about 0.2% sulfur as sulfide into the nickel plate which greatly increases the hardness and tensile strength of the nickel deposit. The preferred Class I addition agents for the purpose of this invention and involving the codeposition of silicon carbide fine particles or other fine hard particles are the benzene or toluene sulfonamide, the di-benzene or di-toluene sulfonimides. These Class I compounds allow the maximum amount of codeposition of the fine particles such as silicon carbide for a given concentration of dispersed fine particles in the nickel baths. The preferred concentration of silicon carbide particles is in the range of 25 to 150 grams/liter. The preferred method for the dispersion of the particles in the nickel baths is with air agitation. Wetting agents such as sodium n-octyl sulfate or sodium 2-ethyl hexyl sulfate may be present in the nickel baths. They are normally used at concentrations of about 0.1 to about 1 g/1.

In this method of plating the mandrel, the nickel plate with the codeposited silicon carbide particles can be applied in two or more steps. For example, a thin plain nickel plate of about 0.5 to about 1 mil can be first applied, then the nickel plate with the codeposited particles of silicon carbide is deposited. With the method of this invention of plating the outside of the mandrel instead of the inside of of the aluminum alloy housing, a coarser grade of silicon carbide can be used instead of smooth, very fine silicon carbide particles which must be used when the inside of the aluminum housing is plated, or otherwise as plating proceeds, the plate becomes impossibly rough. In the method of this invention, the first part of the plate is the most important and is smooth because the plating is started against a smooth surface, and with continued plating the roughness that occurs with the larger silicon carbide particles is beneficial for bonding with the cast aluminum alloy. The nickel plate can be deposited with fine smooth micronized silicon carbide particles for the first part of the nickel plate, then the nickel plate with codeposited silicon carbide particles can be continued from a nickel bath containing dispersed coarser silicon carbide particles to obtain a rough plate. The latter, with or without a zinc plate, will make possible better adhesion to the aluminum alloy that is cast thereon. The use of a thin, pure zinc plate of about 0.1 to 2 mils is preferred for the best bonding procedure whether the rough nickel plate is used or not. The plain nickel plate that may be used at the start of the nickel plating part of the sequence of plates may be made with air agitation turned off in the bath containing the silicon carbide particles, or in a separate bath with no particles, or relatively few particles, present.

The wear-resistant plate may be made of a first nickel plate of about 1 to 3 mils thickness, containing codeposited fine silicon carbide particles followed by an iron plate of similar thickness containing codeposited silicon carbide particles. The final zinc plate for obtaining maximmum adhesion of the aluminium housing is then deposited on the iron plate before the aluminum alloy casting step.

EXAMPLE 3

The same procedure as in Example 1, except that after the copper plate of step (2), chromium plate is desposited for step (3) instead of the iron plate with codeposited silicon carbide particles. The chromium could be plated directly on the copper plate or on a relatively thin nickel or iron plate. The chromium can be plated in a thickness of about 2 mils to about 10 mils. Furthermore, by plating the outside of the mandrel, the highest speed acidic hexavalent chromium plating baths can easily be used that employ both sulfate and fluoride (or complex fluoride) catalysis such as those described in U.S. Pat. Nos. 3,334,033, 2,787,588 and 2,640,022. When the inside of the aluminum housing is chromium plated with a thick deposit, it is generally preferred to use the standard "hard chrome" plating bath employing only the sulfate anion as catalyst because of the possible attack by the fluoride-containing anion on the aluminum in the areas not receiving the chromium plate unless special precautions are taken.

After the chromium plate is deposited, a nickel plate as from a Watts, chloride, or sulfamate bath can be deposited on the chromium, after first giving the chromium plate a low pH nickel strike (Wood's nickel) to secure bond to the chromium plate. The nickel plate may be as thick as 5 mils if the chromium plate is around 2 to 6 mils; or about 1 to 4 mils if the chromium plate is about 4 to about 6 mils. The nickel bath can also contain Class I addition agents enumerated in Example 2 as well as codeposited silicon carbide particles. After the nickel plate, a thin, preferably pure zinc plate is applied before the aluminum alloy casting step to secure maximum adhesion. Instead of nickel plate applied to the chromium plate, iron plate with or without codeposited silicon carbide particles can be applied, as described above. The iron plate is then also preferably given a thin zinc plate before the aluminum casting step. Actually, even though it takes one more step, it is also possible to plate the nickel with iron plate or vice versa, or with cobalt, and then plate with a thin, essentially zinc plate before the aluminum alloy casting step. This is true for Examples 1 and 2 as well. In the aluminum alloy casting step, the zinc with its excellent bond to either nickel, iron, cobalt or their alloys, will not only preserve the cleanliness of the surface of these latter plates and freedom from oxide, but with the heat from the molten aluminum, the zinc will alloy with these underneath metals, and also will alloy compatibly with the molten aluminum.

EXAMPLE 4

The surface of the steel mandrel is first prepared as follows. The steel mandrel is adherently plated with nickel (about 0.2 to 5 mils). This can be done from a plain Watts nickel bath or other acidic nickel baths such as high chloride, or sulfamate, or from a semi-bright or bright nickel plating bath. A semi-bright or bright, smooth nickel plate is preferred. The nickel plate is used for maximum corrosion protection of the mandrel. The nickel plate is then chromium plated with about 0.001 to about 0.2 mil of chromium. The mandrel may be directly chromium plated but it is preferred to nickel plate it first. Also, it may be desirable to use a copper undercoat to the nickel or to the chromium to aid in heat or cold transmission. The mandrel with its chromium surface is now the finished mandrel ready for use in the plating sequences and the final alloy casting steps as described below.

The chromium plated surface of the mandrel is to be considered as one of the parting plate steps, in that it is possible to obtain poor bond to chromium surfaces because of the great passivity of chromium plate. What is most important is to obtain poor adhesion against chromium plate but without obtaining blistered plate. This can be accomplished with the following plated metals, zinc, tin, nickel, cobalt, iron and their alloys when acidic plating baths of these metals are used under controlled conditions. With zinc plat an acidic bath is used of pH about 2 to about 4, preferably about 2 to 3; with tin, a stannous bath of pH of about zero to about 3 is used; and with nickel, cobalt, iron and their alloys, a pH of about 1.5 to about 6 is preferred. These plates can be from a flash plate to about 2 mils in thickness. For zinc and tin, the preferred thickness is around 0.1 mil or thinner, accomplished in about 1 to about 2 minutes plating time. In the case of nickel, cobalt, iron or their alloys even thicker plate than 1 mil can be used directly on the chromium plated mandrel, and in fact their wear-resistant plate with codeposited hard particles, can be plated directly on the chromium plate with poor adhesion for parting. If the pH of the baths for the plating of these metals is much below a pH of about 1 to 1.5, the nickel, cobalt and iron plates adhere too strongly, in fact adhere perfectly if the pH is around zero or lower, and especially when no film-forming additives such as butyne diol are present in these baths. The baths can be acidic sulfate, chloride, bromide, sulfamate, fluoborate, methane sulfonate and other nickel plating salts or mixtures of these salts. In general, the sulfamate type nickel bath with its very low stress is preferred to be used for the first plate against the chromium plated mandrel, with the pH controlled around 4 and the bath temperature at 120°–130°F.

If the mandrel surface is steel, then not only lead, but other low melting point metals and alloys can be plated directly on the mandrel followed by copper or brass from an alkaline bath or nickel from a neutral, or a nearly neutral or an alkaline bath, to obtain parting from the mandrel. For example, instead of a thin lead plate of about 0.1 mil or even less against the mandrel, a thin cadmium (m.p. 321°C) plate can be used. The heat from the molten aluminum casting step will cause the bond of the cadmium plate to break because of melting as well as diffusion into an overlay plate such as copper or brass. Thin tin plate (m.p. 232°C) can also be used with or instead of lead and cadmium. Zinc plate (m.p. 420°C) is however preferred over tin, lead or cadmium or their alloys because it is less expensive and more plentiful than tin and is far less toxic than lead and cadmium. For example, when a thin zinc plate is deposited on the mandrel followed by a thin copper or nickel plate, followed by the wear-resistant plates already described, followed by a final zinc plate, then under the influence of the heat from the aluminum casting step, the thin zinc plate against the mandrel will alloy with the thin copper or nickel overlay and lose its bond to the mandrel. For this sequence of plates, the chromium plated mandrel is preferred, especially with zinc plated directly against it from an acidic (pH 3–4), room temperature, zinc sulfate bath.

The use of the chromium plated mandrel upon which is deposited a plate of either nickel, cobalt, iron or their alloy plates, but preferably nickel, in order to obtain the required poor adhesion to the chromium plated mandrel, for the parting step, offers the shortest sequence of plates for the method of this invention. For example, the chromium plated mandrel can be directly plated with about 0.1 to about 2 mils thickness of nickel from a plain nickel sulfamate bath (with or without about 10 to 20 grams/liter of nickel chloride) of pH about 3.5 to 4.5, and bath temperature of about 120° to 130°F. The low stressed nickel plate will have poor bond to the chromium plated mandrel. It is preferred to use no organic additives in this bath other than a wetting agent to prevent hydrogen pitting. After this first nickel plate is desposited on the chromium with poor adherence but no blistering, the mandrel is transferred to an air agitated, high speed nickel plating bath containing dispersed therein about 50 to 150 grams/liter of fine silicon carbide particles. The preferred high speed bath for the deposition of this wear-resistant nickel plate is the nickel sulfamate bath, although the high chloride or Watts nickel baths can also be used. The maximum codeposition of the silicon carbide fine particles on vertical surfaces takes plate at bath pH values of 4 to 5. Also in these baths the Class I nickel addition agents, such as saccharin, benzene or toluene sulfonamide, o-sulfobenzaldehyde, benzene or naphthalene sulfonic acids, etc., may be used to harden the nickel matrix containing the codeposited fine hard particles. It is important that stress in the nickel plate be kept as low as possible by the use of the above mentioned stress-reducers. This is especially important in Watts and in high chloride nickel baths. In the sulfamate bath a minimum of the stress-reducers or none at all can be used. After the deposition of about 4 mils of the wear-resistant nickel plate of low stress containing from about 2.5 to about 4 wt. percent of codeposited silicon carbide particles, a zinc plate of about 0.1 to about 2 mils thickness is deposited as the final plate prior to the aluminum housing casting step.

Instead of the above wear-resistant plates of nickel and iron or any combination of these wear-resistant plates, it is possible to use chromium plate as the main wear-resistant plate. However, because of the brittleness of the very hard thick chromium plate (hard chrome), it is preferred to plate the chromium deposit with one or more of the tough plates of nickel, cobalt, iron or their alloys in about equal or greater thickness than the chromium plate. This is necessary in order to prevent having a brittle, hard plate resting against the relatively soft surface of the aluminum housing.

The use of a chromium plated mandrel with a first plate of low-stress nickel as from a sulfamate bath, is an excellent method for the parting step. The chromium plated mandrel is left clean, and the parted surface is clean and of the exact finish of the chromium plated mandrel which can be a bright finish or a satin finish. For re-use of the chromium plated mandrel, either no cleaning, or a cathodic cleaning in an alkaline cleaner followed by rinsing is the only step needed. Fresh thin chromium plating of the mandrel needs only rinsing before the parting plate is applied.

This method is consistently superior to the method of plating nickel, cobalt or iron or their alloys on a passivated nickel plated mandrel, and then parting nickel from nickel. The nickel plated mandrel can be passivated by controlled anodic alkaline cleaning, or by a dip in weak chromic acid or chromates, or by other visible or invisible films, such as sulfide films, copper films (immersion copper films), etc.

The chromium plated surface of the mandrel is excellent for a passive surface, and it can be plated not only on steel, and nickel plated steel, but also on Invar, Kovar or stainless steel mandrels. Nevertheless, a stainless steel surface itself or a similar passive surface can also be used without the chromium plate, though the latter surface is preferred.

In repeated runs using a chromium plated steel mandrel plated with low-stress nickel from a sulfamate nickel bath of pH of about 4 and bath temperature of 120°-130°F, poorly adherent plate but with no blistering can be consistently obtained even when subjected to high temperatures 500°C and above. The steel mandrel was tubular in shape and was adherently bright nickel plated, about 2 mils thick, before the chromium plate of about 0.1 mil was applied. It is important that after the zinc plate is applied to the final nickel plate (or iron or cobalt plate), that the mandrel with its plates be pre-heated to about 400°C or even higher before the aluminum alloy casting step is performed. This pre-heating step allows maximum expansion of the mandrel before the hot molten aluminum encircles the plated mandrel surface. Then on cooling with the resulting contraction of the mandrel, it is easy to remove the housing with its now attached wear-resistant running track from the surface of the chromium plated mandrel.

The use of an anti-friction particulate material such as barium sulfate, strontium sulfate or mica to codeposit with the nickel, cobalt or iron plate or their alloys has decided merit in the method of this invention for two reasons. In the first plate against the chromium plated mandrel, such as the low-stress nickel plate from the sulfamate bath, the presence of codeposited barium sulfate fine particles to the extent of 1 to about 3 wt. % allows for an easier parting from the mandrel. In the wear-resistant plate alone or along with codeposited fine silicon carbide particles, it causes decreased friction against a rubbing surface such as the seals used in rotary engines. About 20 to 150 g/l of fine barium sulfate particles of about 0.1 micron to about 5 microns size is the concentration that can be used dispersed in the nickel, cobalt or iron plating baths.

Another plate that can be used instead of zinc or high alloys of zinc such as white or yellow brass electroplate to make possible good adhesion of the aluminum alloy housing cast against the final plate of nickel, cobalt, iron or their alloys, is a thin silver plate instead of the zine plate for the final plate before the aluminum housing casting step. With silver the plate can be uniformly preheated to higher temperatures (500°–700°C) than with zinc plate prior to the aluminum casting step. This allows less shock in the casting step that might make an inferior bond. Silver plate gives much better results for this purpose than copper plate.

What is claimed is:

1. A method for forming a housing comprised essentially of aluminum for the running track of a rotary internal combustion engine which comprises the steps of:

1. electrodepositing a first layer on to a mandrel of the shape of the running track of the rotor, said mandrel having a chromium surface, and said first layer deposited thereon being a metal selected from the group consisting essentially of nickel, cobalt, iron and their alloys and being separable from the mandrel during subsequent steps;

2. electrodepositing a wear-resistant layer on to said first layer
3. then casting a housing comprised essentially of aluminum; and
4. separating the housing from the mandrel with a chromium surface.

2. The method according to claim 1 wherein the mandrel has the shape of the epitrochoidal track of the rotary engine.

3. The method according to claim 1, wherein the first layer electrodeposited on the mandrel with a chromium surface is a wear-resistant plate separable from the mandrel with a chromium surface and selected from the group consisting of nickel, cobalt, iron and their alloys and containing codeposited fine hard nonmetallic particles.

4. The method according to claim 3 wherein the codeposited fine hard particles are silicon carbide.

5. The method according to claim 1 comprising following step (2) forming on to the wear-resistant layer a metallic layer useful for improving adhesion of the aluminum casting to the previously formed wear-resistant layer.

6. The method according to claim 1 wherein the wear-resistant plate is chromium.

7. The method according to claim 5 wherein the metallic layer useful for improving adherence of the aluminum casting is an electrodeposited layer selected from the group consisting of zinc, brass, nickel, cobalt, iron and their alloys.

8. The method according to claim 6 wherein the chromium plate is further plated with a metal from the group consisting of nickel, cobalt, iron and their alloys.

9. A method according to claim 7 wherein the layer useful for improving adhesion of the aluminum casting is essentially zinc deposited onto a metal selected from the group consisting of nickel, cobalt, iron and their alloys, and brass.

10. A method according to claim 1 wherein the wear-resistant plate is essentially nickel plate containing about 2 to about 4 weight percent of fine silicon carbide particles.

11. A method according to claim 1 wherein the wear-resistant plate is essentially iron plate containing about 2 to about 8 weight percent of fine silicon carbide particles.

12. A method according to claim 1 wherein said first layer deposited in step (1) that is separable from the chromium plated mandrel is electrodeposited from an aqueous acidic bath of pH about 1.5 to about 6.

13. A method according to claim 1 wherein the wear-resistant plate is essentially nickel containing about 1 to about 4 weight percent of fine barium sulfate particles.

14. The method according to claim 5 wherein the metallic layer useful for improving the adherence of the aluminum casting is an electrodeposited layer of silver.

15. A method as defined in claim 3, wherein the wear-resistant electroplate is deposited in two separate steps from two separate electroplating baths, the second of which contains fine hard particles that are of larger average size than those dispersed in the bath for the electrodeposition of the first deposit of wear-resistant plate.

* * * * *